US006427276B1

(12) United States Patent
Comer

(10) Patent No.: US 6,427,276 B1
(45) Date of Patent: Aug. 6, 2002

(54) METHOD AND SYSTEM FOR ISOLATING WATER PRESSURE FROM AN APPLIANCE

(75) Inventor: William T. Comer, Las Vegas, NV (US)

(73) Assignee: Robert Brian Edwards, Henderson, NV (US); a part interest ( * ) Notice: Subject to any disclaimer, the term of this patent is extended or adjusted under 35 U.S.C. 154(b) by 0 days.

(21) Appl. No.: 09/922,020

(22) Filed: Aug. 6, 2001

(51) Int. Cl.[7] ..... D06F 39/08
(52) U.S. Cl. ..... 8/158; 68/207
(58) Field of Search ..... 68/207; 8/158

(56) References Cited

U.S. PATENT DOCUMENTS

| | | | | | |
|---|---|---|---|---|---|
| 3,417,782 | A | * | 12/1968 | Mentnech | 68/207 X |
| 3,466,006 | A | * | 9/1969 | Livingston | 251/129.01 |
| 3,868,968 | A | * | 3/1975 | Fuhrmann | 68/207 X |
| 5,285,375 | A | * | 2/1994 | Kim | |
| 5,313,981 | A | * | 5/1994 | Gonzalez | 68/207 X |
| 5,619,614 | A | * | 4/1997 | Payne et al. | |
| 6,003,536 | A | * | 12/1999 | Polverari et al. | 68/207 X |

FOREIGN PATENT DOCUMENTS

| | | | | |
|---|---|---|---|---|
| DE | 2627900 | * | 1/1978 | 68/207 |
| DE | 3702722 | * | 8/1988 | 68/207 |

* cited by examiner

*Primary Examiner*—Philip Coe
(74) *Attorney, Agent, or Firm*—Andrew M. Harris; Harry M. Weiss; Weiss & Moy, P.C.

(57) ABSTRACT

A method and system for isolating water pressure from appliance water connections provides protection from structural damage due to bursting of flexible hoses that connect an appliance to a rigid plumbing water supply. The system includes at least one electrically controllable valve, a connection for coupling the valve to a water supply connection, a connection for attachment to the appliance water supply hoses and an interface for receiving a signal from the appliance control system. An appliance may provide an interface connection for coupling to a control connection on the system, or the system may be connected to existing electrical terminals within a standard appliance that control internal solenoid valves. The system and method isolate water pressure from the flexible hoses supplying water to the appliance, automatically shutting off the supply connections when the appliance does not require water flow.

18 Claims, 2 Drawing Sheets

METHOD AND SYSTEM FOR ISOLATING WATER PRESSURE FROM AN APPLIANCE

BACKGROUND OF THE INVENTION

1. Field of the Invention

The present invention relates generally to appliances with water connections, and more specifically, to a valve system for isolating water pressure from appliance water connections.

2. Background of the Invention

Household and industrial appliances often have fully pressurized water connections. For example, the typical household clothes washer connects to a pair of water distribution lines carrying hot and cold water. A rigid plumbing wall connection is coupled to the appliance by a pair of flexible hoses that connect to water connections on the backside of the washer. These connections carry the full pressure of the water distribution system.

Appliances are often installed in basements or laundry rooms within a house. They are also installed in commercial laundry facilities. Flexible hoses are susceptible to heat damage and wear. If the water is not disconnected or shut off, the flexible hoses may burst, causing flooding. Additionally, flexible hoses generally have shorter life spans than rigid plumbing, which is typically polyvinyl chloride (PVC), copper or steel pipe capable of withstanding higher water pressure levels throughout its life span.

Water damage to a structure caused by connections to the above-described appliances can be very costly, and when unattended, the structure can experience flooding for long periods of time, causing excessive water use and costs as well as damage to the structure.

Therefore, it would be desirable to provide a method and system for isolating water pressure from appliance connections. It would further be desirable to provide a method and system that isolate water pressure automatically so that an unattended facility is not severely damaged when a flexible hose connection to an appliance bursts.

SUMMARY OF THE INVENTION

The above objective of preventing flooding when appliance connections burst is achieved in a method and system that automatically isolate appliance connection hoses from water supply connections. The system includes at least one electrically controllable valve, a connection for coupling the valve to the water supply, a connection for attachment to the appliance hoses and an interface for receiving a control signal from the appliance control system.

The foregoing and other objectives, features, and advantages of the invention will be apparent from the following, more particular, description of the preferred embodiment of the invention, as illustrated in the accompanying drawings.

DETAILED DESCRIPTION OF THE PREFERRED EMBODIMENTS

Figure 1:
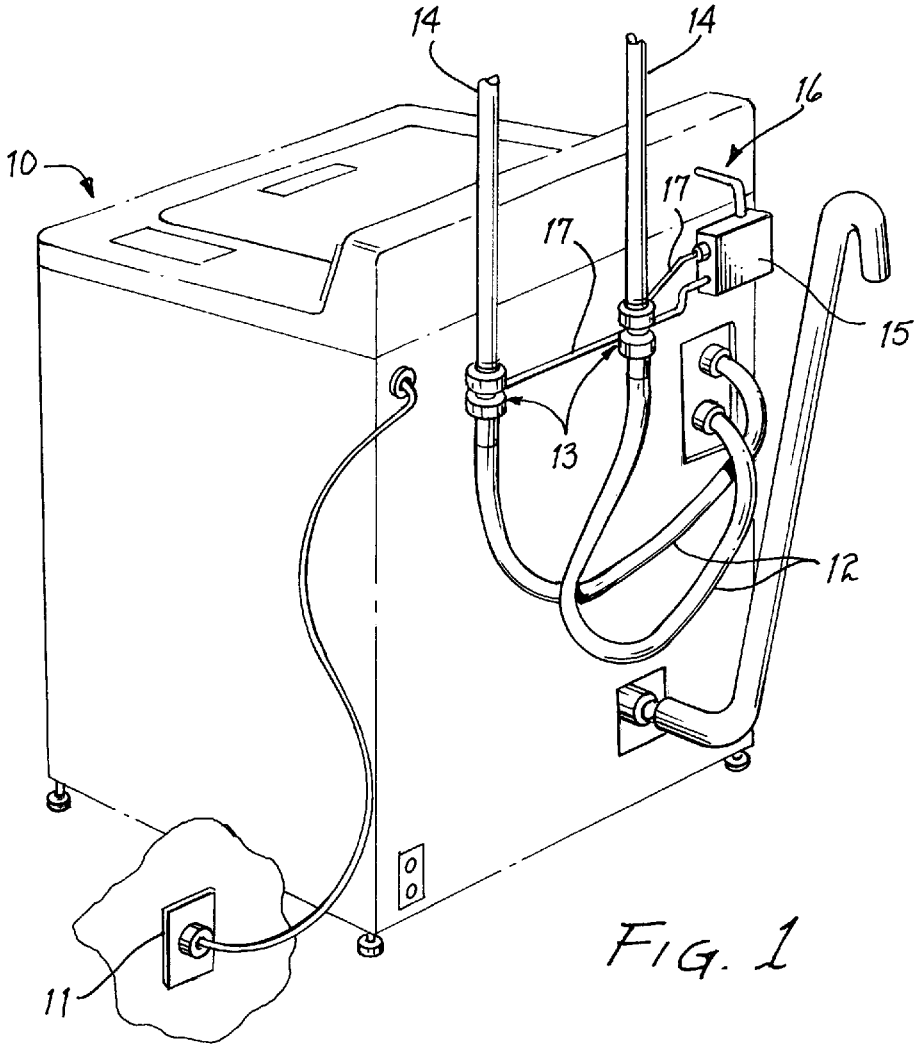
FIG. 1 is a pictorial diagram depicting a household appliance coupled to a system in accordance with an embodiment of the present invention.

Referring now to the figures and in particular to FIG. 1, a household appliance coupled to a system in accordance with an embodiment of the present invention is shown. A washing machine 10, is connected to an electrical power supply 11 and hot and cold water supply lines 14 attached to the structure of a house or other building. Generally, washing machines are connected directly to water supply lines via flexible hoses. However, in the depicted embodiment, washing machine 10 is coupled to electrically controllable valves 13 included within a system in accordance with the present invention. The system operates so that water pressure is isolated from the flexible hoses 12 that connect electrically controllable valves 13 to washing machine 10. The system of the present invention includes at least one electrically controllable valve 13 and the number of electrically controllable valves will generally be dictated by the number of water supply connections required for a particular appliance. For washing machine 10, two electrically controllable valves are used, as washing machines generally have two water supply line 14 connections.

An electrical connection 16 is made to washing machine 10 so that control signals generated within washing machine 10 may be used to control electrically controllable valves 13 in accordance with the washing machine's requirement for hot and/or cold water. A junction box 15 is provided to connect water valve control signals within washer 10 to electrically controllable valves 13 via valve control wires 17. The depicted embodiment has the advantage that no external power supply is required to control electrically controllable valves 13, as the valves are connected in parallel (or replace the connection to) the solenoid valves that are generally found within a washing machine.

A standard washing machine may be used in the above-described configuration by adding external signal connections 16 in parallel with the control connections at each of the internal solenoid valves, but an appliance adapted for use with a system in accordance with an embodiment of the present invention does not require internal valves to control water supply flow, and therefore may be manufactured without internal valves. Additionally, an appliance in accordance with an embodiment of the present invention may include a special interface of signaling a system in accordance with an embodiment of the present invention.

Present-day commercial washing machines often include infrared control interfaces that may be adapted for providing external control signals, or an interface may be added so that a wireless connection for signaling the system of the present invention may be implemented. A radio frequency or other electromagnetic signaling sub-system may alternatively be used to provide a control signal to the system of the present invention, but in these alternative embodiments, an external power supply will generally be required to supply power to control the electrically controllable valves.

Figure 2:
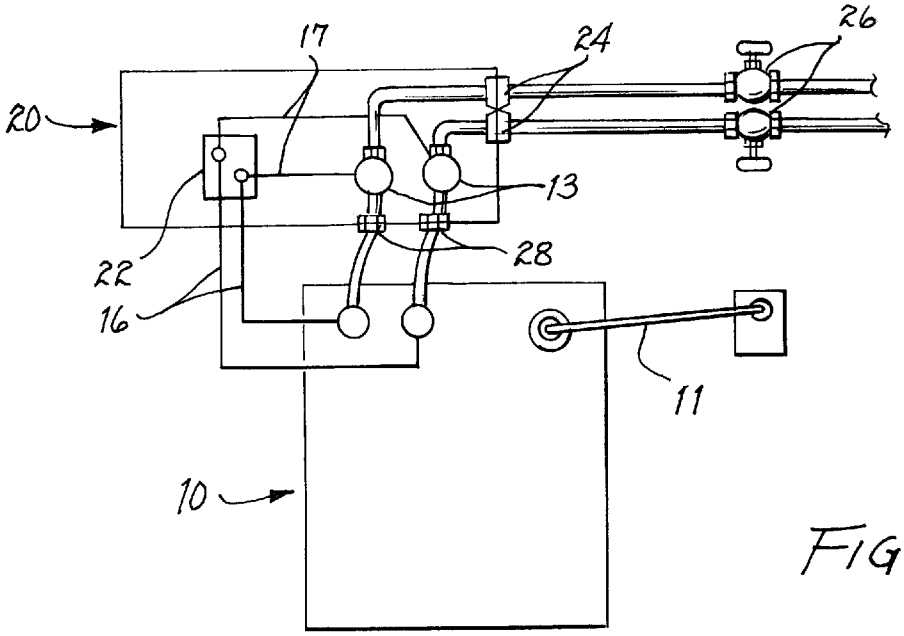
FIG. 2 is a schematic diagram depicting a system in accordance with an embodiment of the present invention.

Referring now to FIG. 2, a schematic diagram of a system 20 in accordance with an embodiment of the present invention is shown coupled washing machine 10. System 20 includes appliance plumbing connectors 28 for connection to flexible hoses 12 (FIG. 1), and supply plumbing connectors 24 for connection to water supply lines 26. The connectors may be threaded pipe connectors, solvent-weldable polyvinyl chloride (PVC) pipe connectors, or other connectors suitable for installation of system 20. Generally, appliance connectors 28 will be threaded male ¾" plumbing connectors, as the flexible hoses supplied with most appliances include female ¾" connections at each end.

System 20 includes an interface 22 for connecting electrical signals 16 from washing machine 10. In a configuration using wireless or low power signals coupled washing machine 10, interface 22 may also include a control circuit to receive the signal from washer 10 and generate electrical signals to control electrically controllable valves 13, which are included within system 20.

Figure 3:
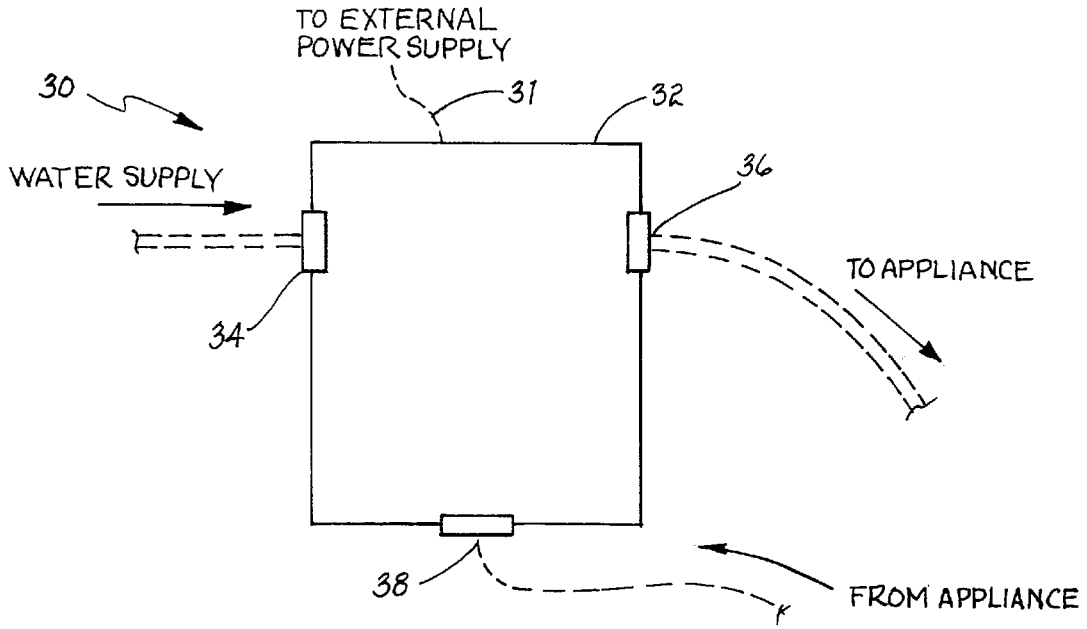
FIG. 3 is a pictorial diagram depicting a system in accordance with an embodiment of the present invention.

Referring now to FIG. 3, a system 30 in accordance with an embodiment of the present invention is depicted. System 30 is packaged in a housing 32 that contains the electrically controllable valves and any control circuits required. A supply water connector 34 and an appliance water connector 36 are provided on an external surface of housing 32 and an interface connection 38 is provided for a hard-wired connection to control signals from a connected appliance. Additionally, for wireless connections, an external power supply connection 31 may be included to provide power for operating internal control circuits and valves. A battery may be used within housing 32 to supply operating power to circuits and valves, but as solenoid valves generally require large currents to switch or activate, an external power supply may be required.

Figure 4:
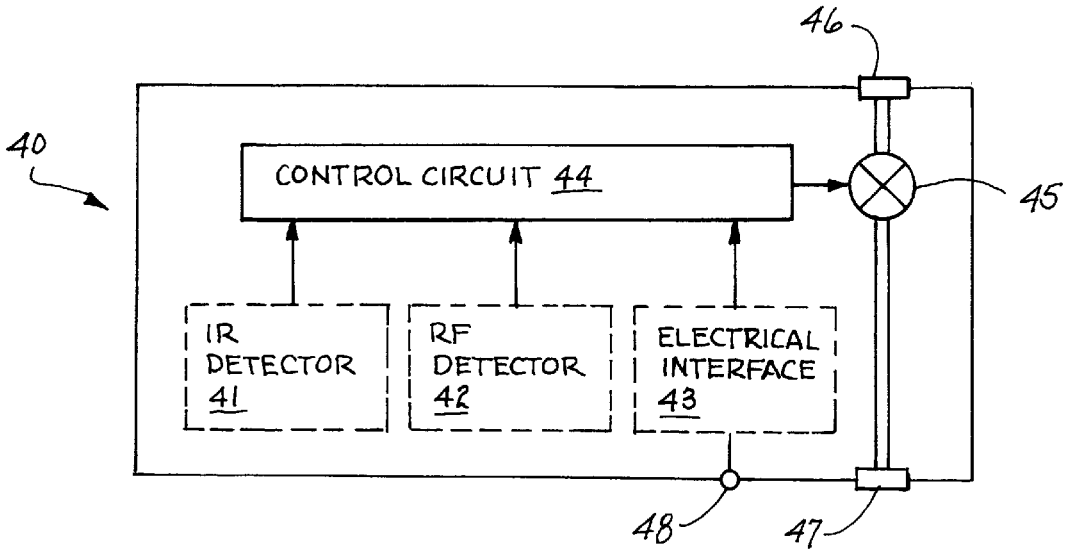
FIG. 4 is an electrical block diagram of a system in accordance with an embodiment of the present invention.

Referring now to FIG. 4, a system 40 in accordance with an embodiment of the present invention is depicted in a block diagram. A signaling circuit is included, which may be an infrared detector 41, an RF detector 42 (or other electromagnetic signaling detector) or an electrical interface 43. The signaling circuit is coupled to control circuit 44, which provides a signal to control electrically controllable valve 45. If electrical interface 43 is used, an external connection is provided by connector 48. In an embodiment where the signal connected to connector 48 is a high-current solenoid control signal the electrical interface 43 and control circuit 44 may connect connector 48 directly to electrically controllable valve 45. Water supply connector 46 is coupled to appliance water connector 47 by electrically controllable valve 45, providing a complete system for isolating water pressure from an appliance in response to a signal from the appliance.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A system for isolating water pressure from an appliance, comprising:

at least one electrically controllable valve for isolating water pressure from said appliance;

at least one appliance water connection for coupling said electrically controllable valve to an end of an external appliance water supply hose;

at least one water supply connection for coupling said electrically controllable valve to an external water supply; and an interface electrically coupled to said controllable valve for receiving a wireless signal from said appliance, whereby water pressure is isolated from said appliance water connection by said electrically controllable valve in response to said wireless signal.

2. The system of claim 1, wherein said appliance is a washing machine and wherein said at least one electrically controllable valve comprises a hot water valve and a cold water valve.

3. The system of claim 1, wherein said at least one electrically controllable valve is a solenoid valve.

4. The system of claim 1, further comprising a housing containing said at least one electrically controllable valve, wherein said at least one appliance water connection and said water supply connection comprise plumbing connectors having interfaces on an external surface of said housing.

5. The system of claim 4, wherein said plumbing connectors are threaded pipe connectors.

6. The system of claim 4, wherein said plumbing connectors are slip-fit connectors for attachment via chemical weld.

7. The system of claim 1, wherein said interface comprises:

an infrared receiver for receiving infrared signals transmitted from said appliance; and a control circuit coupled to said infrared receiver for generating an electrical signal in response to a received signal and further coupled to said at least one electrically controllable valve, whereby said at least one electrically controllable valve is operated in response to said generated electrical signal.

8. The system of claim 1, wherein said interface comprises:

a receiver for receiving electromagnetic signals transmitted from said appliance; and a control circuit coupled to said receiver for generating an electrical signal in response to a received signal and further coupled to said at least one electrically controllable valve, whereby said at least one electrically controllable valve is operated in response to said generated electrical signal.

9. A system for isolating water pressure from an appliance, comprising:

at least one appliance water connection for coupling said system to an end of an external appliance water supply hose;

at least one water supply connection for coupling said system to an external water supply; and means for isolating said appliance water connection, including wireless reception means for receiving a wireless signal from said appliance.

10. A household appliance having a water supply connection, comprising:

at least one appliance water connection for said appliance to an end of an external appliance water supply hose;

an internal control circuit for generating an electrical signal for controlling an electrically operated valve to control flow through said appliance water connection; and a transmission device coupled to said internal control circuit for supplying a wireless signal to an external system, whereby said external system isolates water pressure from said whereby water pressure is isolated from said external appliance water supply hose response to receiving said wireless signal.

11. The household appliance of claim 10, wherein said electrical interface comprises an infrared transmitter for transmitting said wireless signal.

12. The household appliance of claim 10, wherein said electrical interface comprises an electromagnetic signal generator for transmitting said wireless signal.

13. The household appliance of claim 10, adapted for external water supply control, wherein said external water control comprises the sole means for controlling the flow of water from said supply.

14. A method for isolating water pressure from a household appliance comprising:

receiving a wireless signal from said household appliance at an external interface;

in response to said received signal, operating at least one electrically controllable valve for isolating water pressure from said household appliance.

15. The method of claim 14, wherein said receiving receives an infrared signal from said household appliance, and further comprising generating a control signal in response to said receiving for operating said electrically controllable valve.

16. The method of claim 14, wherein said receiving receives an electromagnetic signal from said household appliance, and further comprising generating a control signal in response to said receiving for operating said electrically controllable valve.

17. The method of claim 14, wherein said household appliance is a washing machine, and wherein said operating operates said electrically controllable valve to fill a basin within said washing machine.

18. The method of claim 14, wherein said household appliance includes a water flow control device operated by an electrical signal, and wherein said receiving receives a external signal coupled to said electrical signal.

* * * * *